US011019952B2

(12) United States Patent
Machande et al.

(10) Patent No.: US 11,019,952 B2
(45) Date of Patent: Jun. 1, 2021

(54) BLOW MOLDED DECORATIVE POST ASSEMBLY

(71) Applicant: Custom-Pak, Inc., Clinton, IA (US)

(72) Inventors: Joshua Machande, Miles, IA (US); Rick Braasch, Davenport, IA (US); Ronald A. Zimmer, Dewitt, IA (US)

(73) Assignee: Custom-Pak, Inc., Clinton, IA (US)

( * ) Notice: Subject to any disclaimer, the term of this patent is extended or adjusted under 35 U.S.C. 154(b) by 190 days.

(21) Appl. No.: 16/380,392

(22) Filed: Apr. 10, 2019

(65) Prior Publication Data

US 2020/0323375 A1 Oct. 15, 2020

(51) Int. Cl.

| | |
|---|---|
| ***A47G 29/12*** | (2006.01) |
| ***E04H 12/22*** | (2006.01) |
| ***E04H 12/02*** | (2006.01) |

(52) U.S. Cl.

CPC ..... *A47G 29/1216* (2013.01); *E04H 12/02* (2013.01); *E04H 12/2292* (2013.01)

(58) Field of Classification Search

CPC .. A47G 29/1216; E04H 12/2292; E04H 12/02
USPC ..... 232/39; 52/835, 288.1, 832; 248/146
See application file for complete search history.

(56) References Cited

U.S. PATENT DOCUMENTS 4,588,123 A * 5/1986 Plew ..... A47G 29/1209 232/39
4,759,161 A * 7/1988 Kucyk, Jr. ..... E01F 9/635 404/10
5,323,583 A 6/1994 Venegas, Jr.
5,361,977 A * 11/1994 Ogrodnick, Jr. ... A47G 29/1216 232/39
5,664,729 A * 9/1997 Ladewig ..... A47G 29/1216 232/39
5,932,161 A * 8/1999 Barton, Jr. ..... A47G 29/1216 264/247
5,984,172 A 11/1999 Easterwood
6,098,353 A * 8/2000 Stanfield ..... E01F 9/685 52/169.13
6,167,665 B1 * 1/2001 Dame ..... E04B 2/7425 52/239
6,513,284 B1 * 2/2003 Sandlin ..... A01G 9/022 232/39
6,575,423 B2 6/2003 Erwin
7,163,140 B1 * 1/2007 Kaiser ..... A47G 29/1216 232/38
7,866,120 B2 * 1/2011 Prenn ..... E01F 15/141 52/835

(Continued)

*Primary Examiner* — William L Miller
(74) *Attorney, Agent, or Firm* — St. Onge Steward Johnston & Reens, LLC

(57) ABSTRACT

A kit for assembling a blow molded post cover including a sleeve and a base. The sleeve having an open bottom end and a hollow interior for receiving a post. The base including a top cap having a first through-hole for receiving the sleeve; a bottom cap having a second through-hole for receiving the sleeve; and a plurality of side panels securable to the top and bottom caps. Each of the plurality of side panels having a first side end, a second side end, and one or more protrusions on a rear surface such that each of the one or more protrusions bears against the sleeve when the base is installed on the sleeve. The first side end of any one of the plurality of side panels is configured to interlock with the second side end of any other one of the plurality of side panels.

20 Claims, 9 Drawing Sheets

(56) References Cited

U.S. PATENT DOCUMENTS

| | | | | |
|---|---|---|---|---|
| 8,402,975 | B2 | 3/2013 | Venegas, Jr. | |
| 9,010,069 | B2 | 4/2015 | Bernard | |
| 9,482,023 | B1 | 11/2016 | Carmody | |
| 10,450,759 | B1 * | 10/2019 | Carmody | A47G 29/1216 |
| 10,501,957 | B1 * | 12/2019 | Borowiak | E04H 12/2269 |
| 10,595,658 | B2 * | 3/2020 | D'Andrea | A47G 29/121 |
| 2004/0244329 | A1 * | 12/2004 | Delantar, Jr. | A47G 29/1216 52/832 |
| 2005/0005540 | A1 * | 1/2005 | Nesbitt | E04H 12/2292 52/169.9 |
| 2005/0155313 | A1 * | 7/2005 | Platt | E04H 17/20 52/832 |
| 2005/0274938 | A1 * | 12/2005 | Nesbitt | E04H 12/2292 256/1 |
| 2008/0149791 | A1 * | 6/2008 | Bradley | E04H 12/2269 248/220.21 |
| 2009/0126298 | A1 * | 5/2009 | Salcedo | E04H 12/2292 52/288.1 |
| 2009/0320396 | A1 * | 12/2009 | Knudsen | E04F 19/00 52/297 |
| 2010/0277290 | A1 * | 11/2010 | Knudsen | E02D 5/26 340/10.52 |
| 2011/0030292 | A1 * | 2/2011 | Oram | B28B 11/001 52/173.1 |
| 2011/0163213 | A1 * | 7/2011 | Borowiak | A47G 29/1216 248/219.2 |
| 2013/0061499 | A1 * | 3/2013 | Berglund | A63H 33/16 40/607.1 |
| 2014/0131531 | A1 * | 5/2014 | Zimmer | F16L 25/10 248/127 |
| 2017/0262800 | A1 * | 9/2017 | Dorpfeld | A47G 29/16 |
| 2018/0078069 | A1 * | 3/2018 | Dry | A47G 29/1216 |

* cited by examiner

BLOW MOLDED DECORATIVE POST ASSEMBLY

FIELD OF THE INVENTION

The present invention relates to protective post covers, and more particularly blow molded decorative post covers.

BACKGROUND OF THE INVENTION

Typically, mailboxes are mounted on wooden posts. These posts are vulnerable to damage and deterioration from weather, time, lawn mowers, vehicles, and the like. Traditional measures taken to protect wooden posts include painting the posts, partially or fully encasing the posts in brick or stone columns, planting shrubbery or bushes around the posts, or some combination thereof. However, these solutions are complex and costly: paint needs to be periodically reapplied, bushes need to be trimmed and maintained, and stone columns are expensive to build and replace if damaged.

Therefore, a need exists for a protective post cover having a simple, yet strong, design that is formed of a durable, cost-effective material. It is also desirable for such a protective post cover to have decorative features that give the impression of an expensive stone column.

SUMMARY OF THE INVENTION

Accordingly, embodiments of the present invention include devices, kits, and methods for assembling a blow molded decorative post cover. As used herein, the terms "first" and "second" are used to distinguish one element, set, object, or thing from another, and are not used to designate relative position or arrangement in time.

In one embodiment of the present invention, a blow molded post cover having a sleeve and a base is provided. The sleeve has an open bottom end and a hollow interior for receiving a post. The base includes a top cap, a bottom cap, and a plurality of side panels securable to the top cap and the bottom cap. The top cap has a first through-hole for receiving the sleeve, and the bottom cap has a second through-hole for receiving the sleeve. Each of the plurality of side panels has one or more protrusions on a rear surface such that each of the one or more protrusions bears against the sleeve when the base is installed on the sleeve.

In some embodiments, each of the plurality of side panels also includes a top end securable to the top cap of the base, a bottom end securable to the bottom cap of the base, a first side end, and a second side end. The first side end of any one of the plurality of side panels is configured to interlock with the second side end of any other one of the plurality of side panels.

In some embodiments, the first side end and the second side end of each of the plurality of side panels includes a series of notches and extensions. The notches and extensions of the first side end of a first side panel are configured to interlock with the extensions and notches of the second side end of a second side panel to secure the first side panel to the second side panel and form a seam having a plurality of transverse line segments. Each of the plurality of side panels also includes a decorative surface located on a front face of the side panel and continuing onto surfaces of each extension of the first and second side ends.

In some embodiments, the plurality of transverse line segments of the seam are straight line segments. Each straight line segment is generally perpendicular to its adjacent straight line segments.

In some embodiments, each of the plurality of side panels also includes at least one male slide and at least one male snap-lock located on the first side end, and at least one female slide and at least one female snap-lock located on the second side end. When a first side panel is interlocked with a second side panel, the at least one male slide of the first side panel engages the at least one female slide of the second side panel to align the first and second side panels, and the at least one male snap-lock of the first side panel engages the at least one female snap-lock of the second side panel to lock the first and second side panels together.

In some embodiments, the sleeve also includes a plurality of interior flexible protuberances configured to bear against the post.

In some embodiments, the base also includes a first channel adjacent peripheral edges of a bottom surface of the top cap, and a second channel adjacent peripheral edges of a top surface of the bottom cap. The first channel is configured to receive a top flange of the top cap of each of the plurality of side panels to secure the side panels to the top cap. The second channel is configured to receive a bottom flange of the bottom end of each of the plurality of side panels to secure the side panels to the bottom cap.

In some embodiments, the sleeve also includes a plurality of tapered exterior projections configured to interact with the top and bottom caps to secure the base to the sleeve.

In some embodiments, the sleeve also includes at least one arm. The at least one arm is adapted to support at least one mailbox.

In some embodiments, each of the top cap of the base, the bottom cap of the base, and the plurality of side panels of the base have decorative outer surfaces.

In another embodiment of the present invention, a method for assembling a blow molded post cover is provided. The method includes the steps of: inserting a sleeve through a first through-hole of a top cap of a base; securing a body of the base to the top cap; placing the sleeve in a second through-hole of a bottom cap of the base; and attaching the bottom cap of the base to the sleeve. The sleeve has an open bottom end and a hollow interior for receiving a post.

In some embodiments, before the securing step, the method also includes the step of interlocking a plurality of side panels together to form a body of the base. Each of the plurality of side panels includes a first side end having at least one male slide and at least one male snap-lock, and a second side end having at least one female slide and at least one female snap-lock. When a first side panel is interlocked with a second side panel, the at least one male slide of the first side panel engages the at least one female slide of the second side panel to align the first and second side panels, and the at least one male snap-lock of the first side panel engages the at least one female snap-lock of the second side panel to lock the first and second side panels together.

In some embodiments, the method also includes the step of inserting a post through the open bottom end into the hollow interior of the sleeve.

In some embodiments, the sleeve also includes a plurality of tapered exterior projections configured to interact with the top and bottom caps to secure the base to the sleeve.

In some embodiments, the method also includes the step of installing at least one arm to the sleeve. The at least one arm is adapted to support at least one mailbox.

In an alternative embodiment of the present invention, a kit for assembling a blow molded post cover is provided. The kit includes a sleeve and a base. The sleeve has an open bottom end and a hollow interior for receiving a post. The base includes a top cap having a first through-hole for receiving the sleeve, a bottom cap having a second through-hole for receiving the sleeve, and a plurality of side panels securable to the top and bottom caps. Each of the plurality of side panels has a first side end, a second side end, and one or more protrusions on a rear surface such that each of the one or more protrusions bears against the sleeve when the base is installed on the sleeve. The first side end of any one of the plurality of side panels is configured to interlock with the second side end of any other one of the plurality of side panels.

In some embodiments, the first side end and the second side end of each of the plurality of side panels includes a series of notches and extensions. The notches and extensions of the first side end of a first side panel are configured to interlock with the extensions and notches of the second side end of a second side panel to secure the first side panel to the second side panel and form a seam having a plurality of transverse line segments. The plurality of transverse line segments are straight line segments, and each straight line segment is generally perpendicular to its adjacent straight line segments. Each of the plurality of side panels also includes a decorative surface located on a front face of the side panel and continuing onto surfaces of each extension of the first and second side ends.

In some embodiments, each of the plurality of side panels also includes at least one male slide and at least one male snap-lock located on the first side end, and at least one female slide and at least one female snap-lock located on the second side end. When a first side panel is interlocked with a second side panel, the at least one male slide of the first side end engages the at least one female slide of the second side panel to align the first and second side panels, and the at least one male snap-lock of the first side panel engages the at least one female snap-lock of the second side panel to lock the first and second side panels together.

In some embodiments, the sleeve also includes a plurality of interior flexible protuberances configured to bear against the post.

In some embodiments, the base also includes a first channel adjacent peripheral edges of a bottom surface of the top cap, and a second channel adjacent peripheral edges of a top surface of the bottom cap. The first channel is configured to receive a top flange of a top end of each of the plurality of side panels to secure the side panels to the top cap. The second channel is configured to receive a bottom flange of a bottom end of each of the plurality of side panels to secure the side panels to the bottom cap.

In some embodiments, the sleeve also includes a plurality of tapered exterior projections configured to interact with the top and bottom caps to secure the base to the sleeve.

In some embodiments, the kit also includes at least one arm securable to the sleeve. The at least one arm is adapted to support at least one mailbox.

In some embodiments, each of the top cap of the base, the bottom cap of the base, and the plurality of side panels of the base have decorative outer surfaces.

Other objects of the present invention and its particular features and advantages will become apparent from the following detailed description, claims, and accompanying drawings.

DETAILED DESCRIPTION OF THE INVENTION

Figure 1:
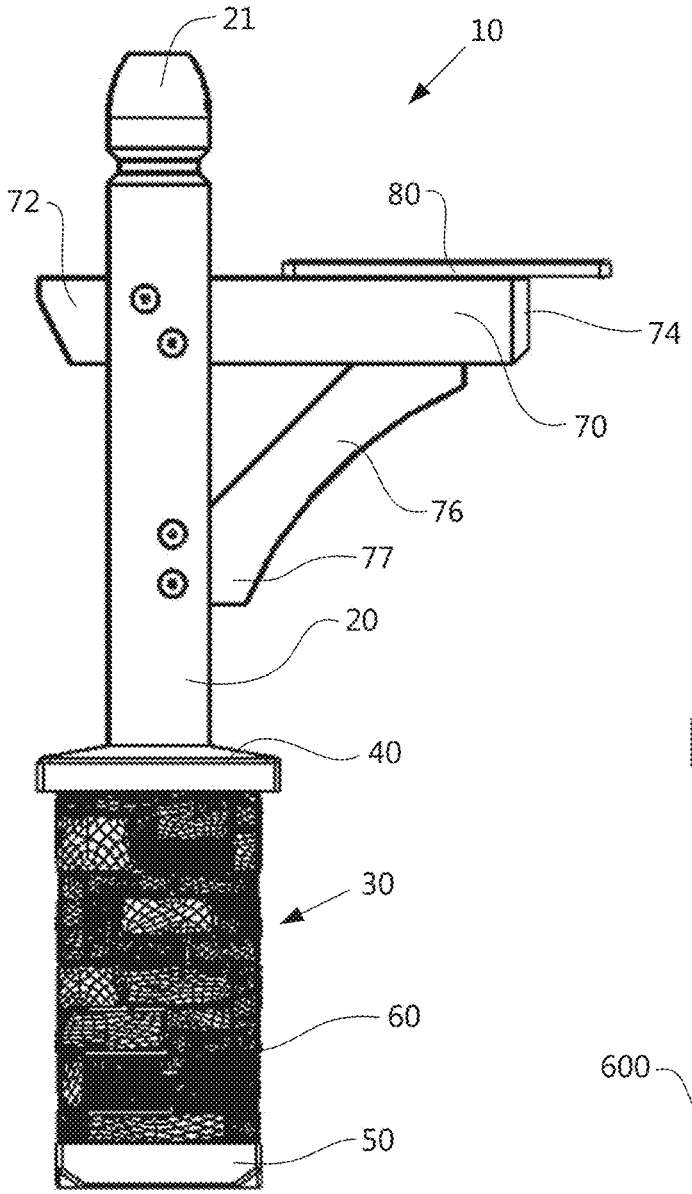
FIG. 1 is a side elevational view of a decorative blow-molded post cover according to an embodiment of the present invention.

Referring now to the drawings, wherein like reference numerals designate corresponding structure throughout the views. The following examples are presented to further illustrate and explain the present invention and should not be taken as limiting in any regard.

Figure 2:
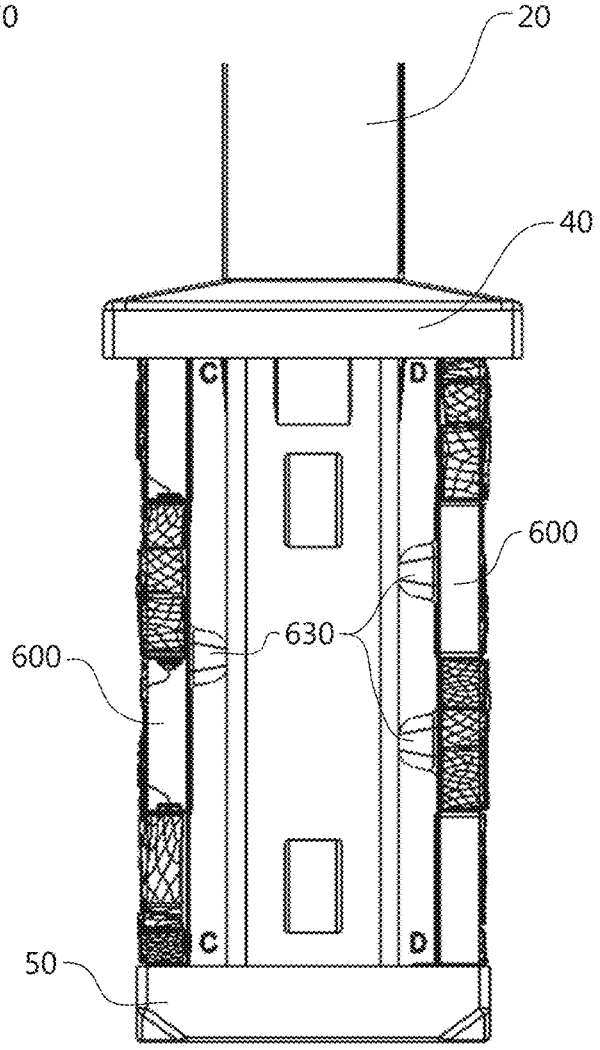
FIG. 2 is side elevational detail view of a partially formed base of the post cover of FIG. 1.

FIG. 1 shows a blow-molded post cover 10 having a sleeve 20 and a base 30. The base 30 is formed of a top cap 40, a bottom cap 50, and a body 60 formed of side panels 600 that surround the sleeve 20, as shown in FIG. 2. Although the embodiment depicted in the drawing figures has four side panels forming a rectangular base, it is understood that any number of side panels can be used to form various shaped bases, such as cylindrical, triangular, hexagonal, etc. Preferably, the top cap 40, bottom cap 50, and body 60 have decorative outer surfaces to give the base 30 the appearance of being formed of traditional, more expensive materials, such as stone, brick, concrete, etc.

Figure 3:
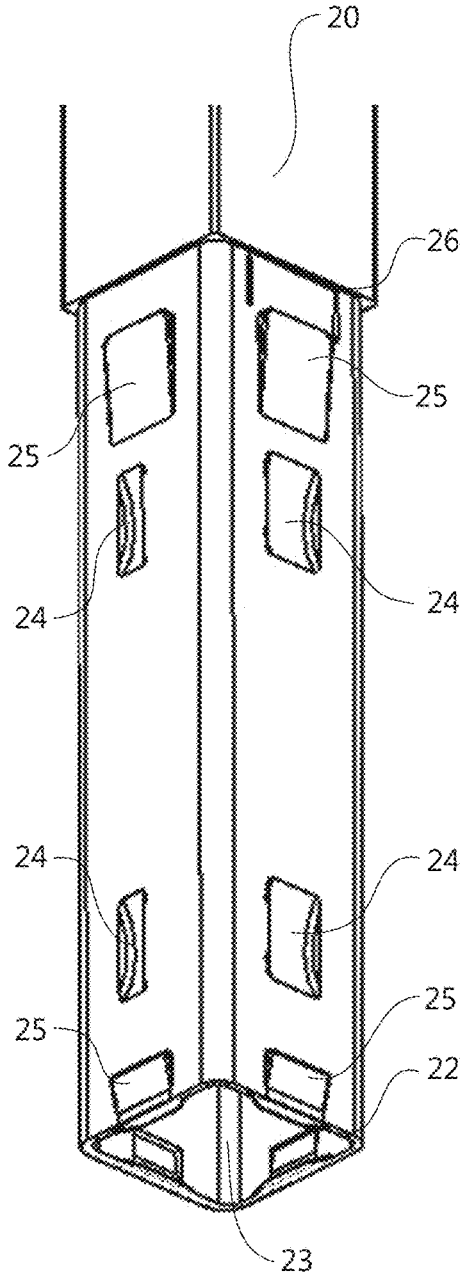
FIG. 3 is a bottom perspective detail view of the bottom end of the sleeve of the post cover of FIG. 1.

The sleeve 20 has an open bottom end 22 and a hollow interior 23, as depicted in FIG. 3. After the post cover 10 is assembled, it is preferably installed onto an existing post, which has already been buried and secured in the desired location, by inserting the post through the open bottom end 22 into the hollow interior 23 of the sleeve 20. In preferred embodiments, the sleeve has a plurality of interior protuberances 24 configured to bear against the post and better secure the sleeve 20 to the post. The interior protuberances 24 are preferably curved and flexible to account for variations in the post's dimensions such that the sleeve 20 is in constant contact with the post. Although the sleeve shown in the drawing figures has a generally square cross-section, it is understood that the sleeve can be differently shaped to conform to the shape of the post to be covered, such as cylindrical, triangular, hexagonal, etc.

Figure 4:
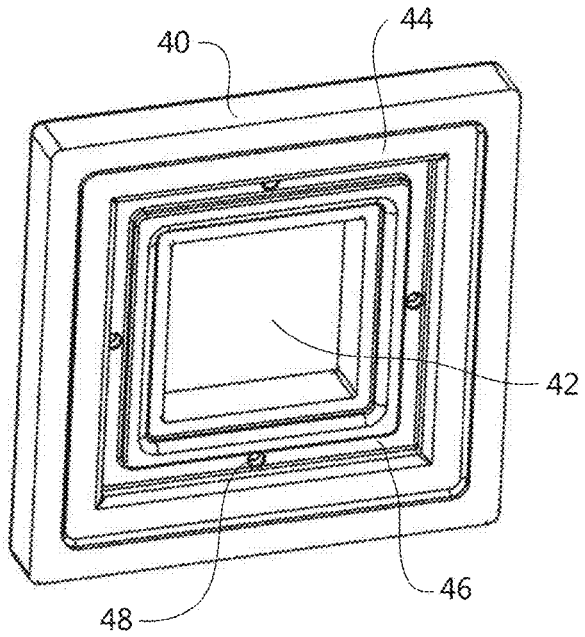
FIG. 4 is a bottom perspective view of the top cap of the base of the post cover of FIG. 1.
Figure 5:
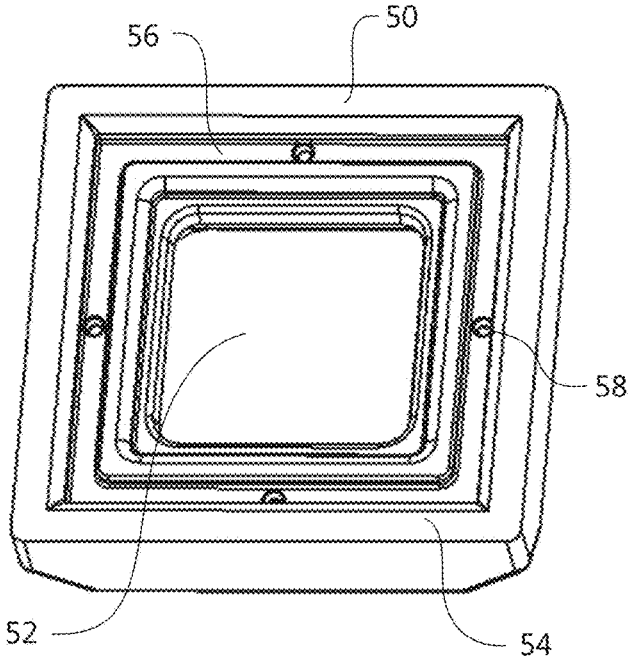
FIG. 5 is a top perspective view of the bottom cap of the base of the post cover of FIG. 1.
Figure 6:
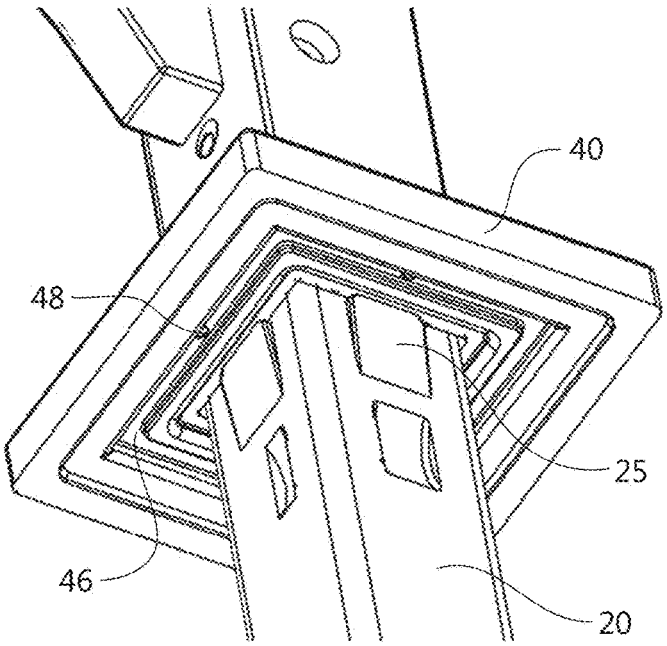
FIG. 6 is a bottom perspective detail view of the top cap of FIG. 4 attached to the sleeve of FIG. 3.

Preferably, the sleeve 20 has a plurality of exterior projections 25. The projections 25 taper along their lengths such that the top end of each projection 25 extends a distance out from the outer surface of the sleeve 20 and the bottom end of each projection 25 is essentially flush with the outer surface of the sleeve 20. The projections 25 secure the top cap 40 and the bottom cap 50 to the sleeve 20. The top cap 40 and the bottom cap 50 each have respective through-holes 42 and 52, as shown in FIGS. 4-5. Preferably, through-holes 42/52 have a dimension that is equal to, or slightly greater than, the outer dimension of the sleeve 20. Thus, as the sleeve 20 is inserted through the through-holes 42/52, the top cap 40 and the bottom cap 50 slide along the tapered projections 25 and snap into place after passing the top ends of the projections, which resist removal of the top and bottom caps 40/50. To prevent further insertion of the sleeve 20 through the through-holes 42/52, the sleeve 20 preferably has a perimeter jog 26 that increases the outer dimension of the sleeve 20 to a dimension greater than the dimension of the through-holes 42/52. In preferred embodiments, the distance between the uppermost projection 25 and the perimeter jog 26 is approximately the thickness of the top cap 40 such that the assembled base 30 is locked in place at a desired location on the sleeve 20, as depicted in FIG. 6.

Figure 7:
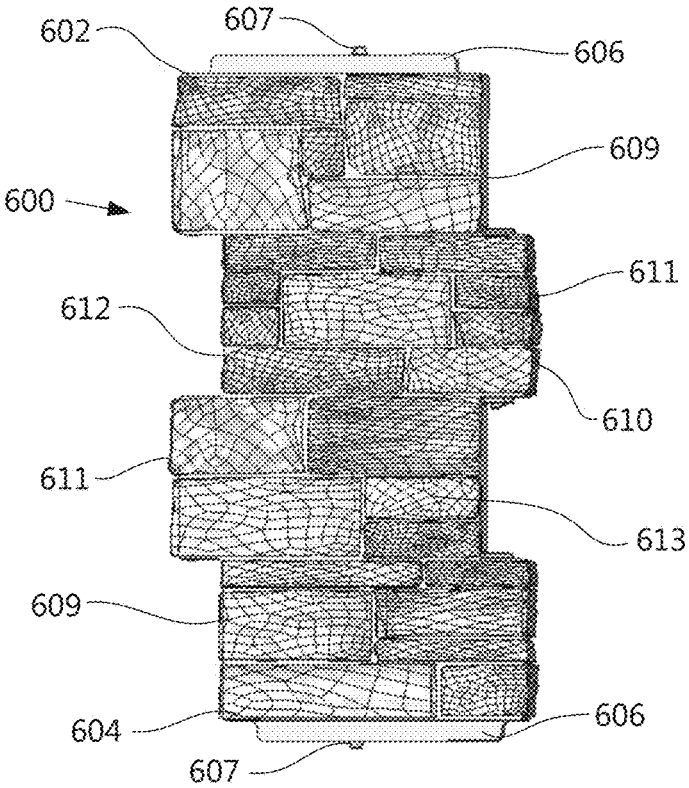
FIG. 7 is a front elevational view of a side panel of the base of the post cover of FIG. 1.
Figure 8:
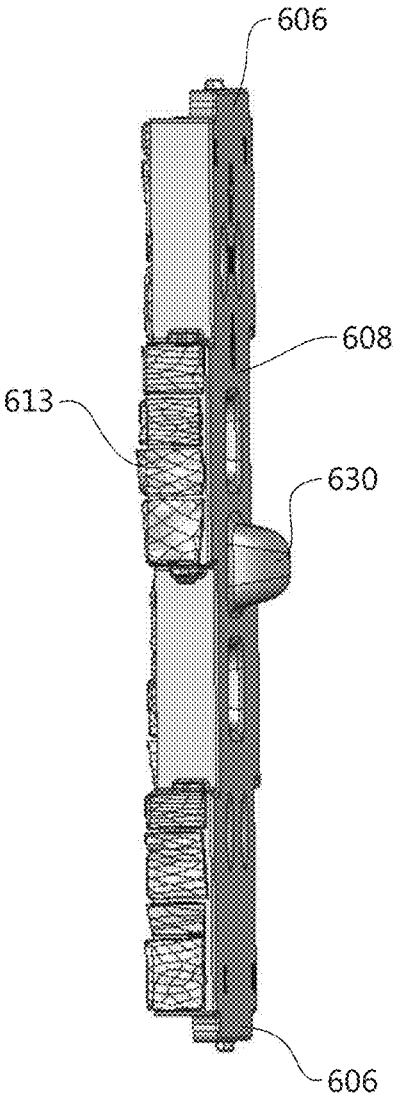
FIG. 8 is a side perspective view of the side panel of FIG. 7.

In preferred embodiments, each of the side panels 600 have the same structure, dimensions, and design to make assembly of the post cover 10 as simple as possible. As shown in FIG. 7, the side panels 600 have a top end 602 and a bottom end 604. The top end 602 has a flange 606 extending up from the top of the side panel 600, and the bottom end 604 has a flange 606 extending down from the bottom of the side panel 600. Preferably, the top and bottom flanges 606 each have an interior surface that is essentially flush with the rear surface 608 of the side panel, as shown in FIG. 8. The top and bottom flanges 606 are configured to nest within corresponding channels 46/56 located in a bottom surface 44 of the top cap 40 and a top surface 54 of the bottom cap 50 to secure the side panels to the top and bottom caps. The channels 45/56 are preferably located adjacent the respective perimeters of the top and bottom caps 40/50 such that the assembled base forms a column with the perimeters of the top and bottom caps 40/50 being greater than the perimeter of the body 60. In some embodiments, top and bottom flanges 606 each have a tab 607 that interacts with corresponding recesses 48/58 to help align and better secure the side panel 600 to the top and bottom caps 40/50.

Figure 13:
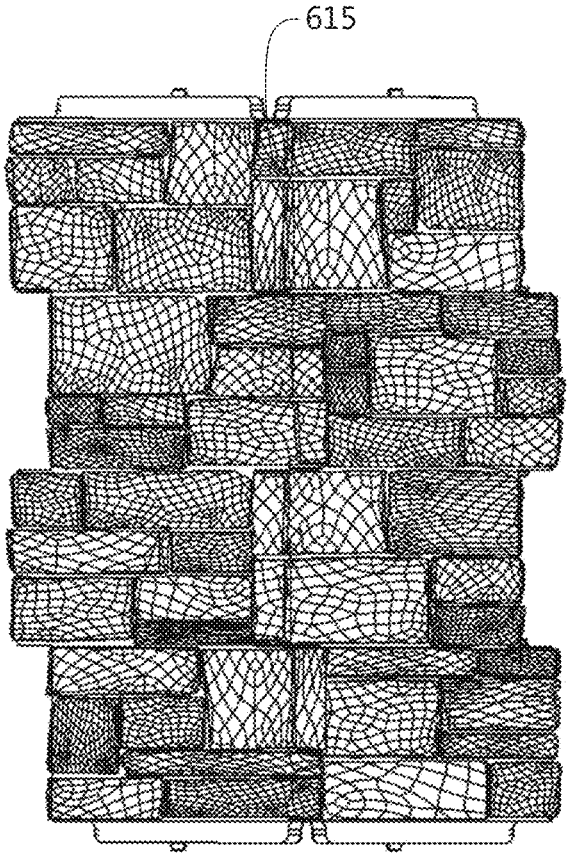
FIG. 13 is a front perspective view of two side panels secured together.
Figure 14:
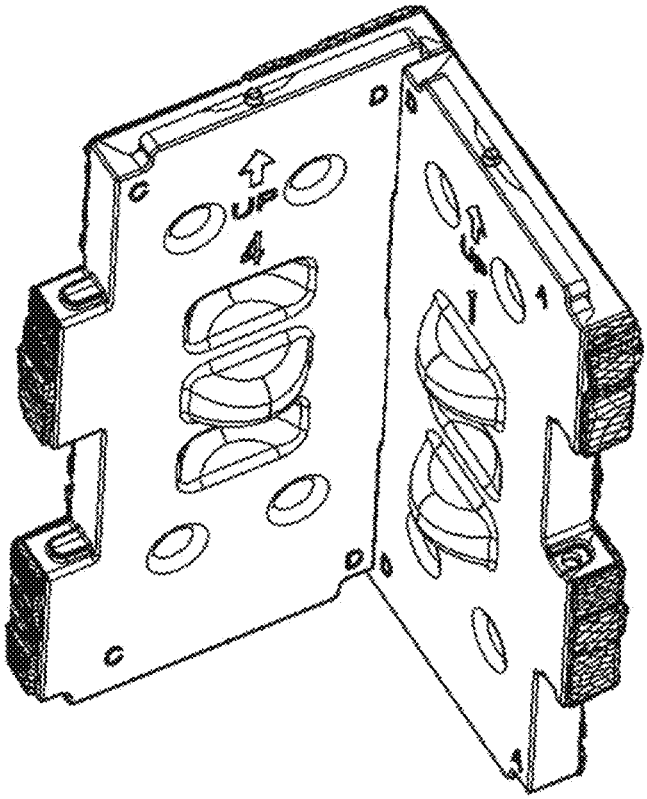
FIG. 14 is a rear perspective view of the side panels of FIG. 13.
Figure 15:
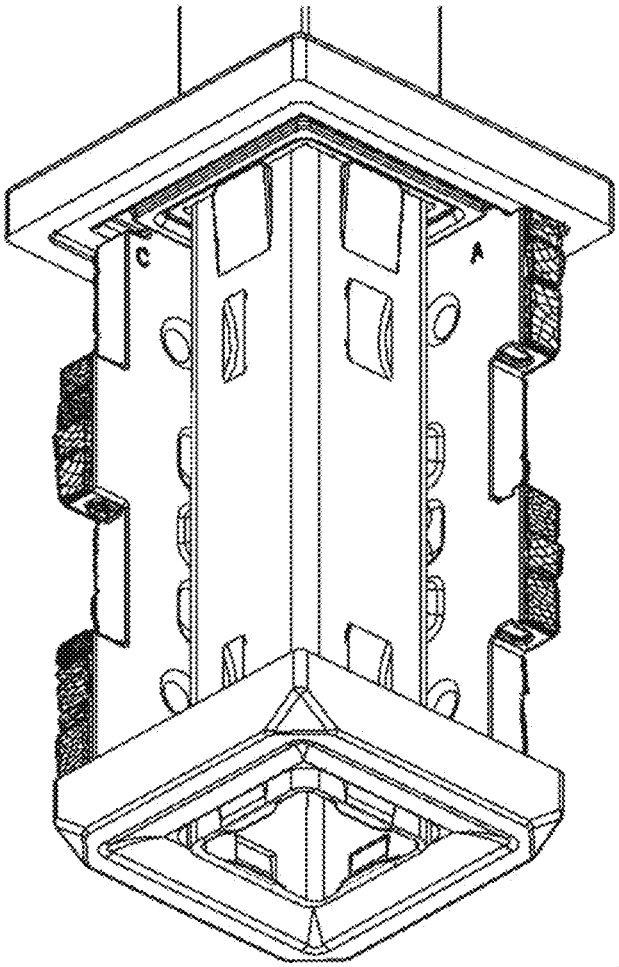
FIG. 15 is a bottom perspective detail view of a partially formed base secured to the sleeve of FIG. 3.
Figure 16:
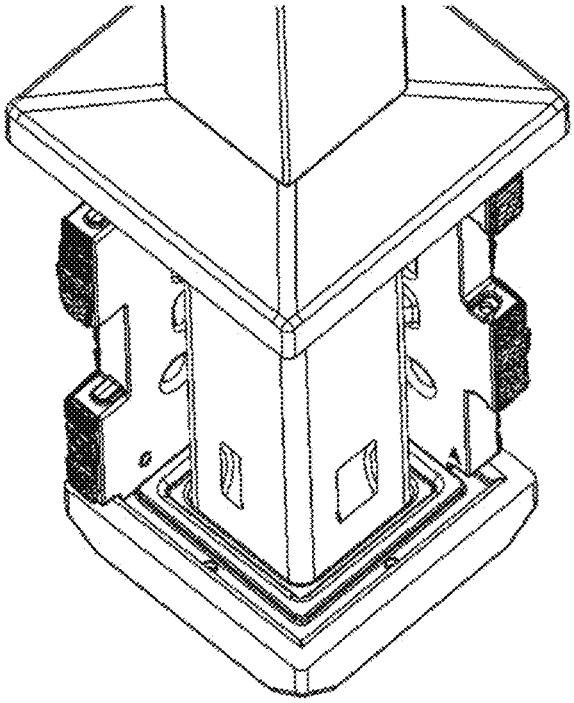
FIG. 16 is a top perspective detail view of a partially formed base secured to the sleeve of FIG. 3.

The side panels 600 have a first side end 610 and a second side end 612. Preferably, the side ends have corresponding designs such that the first side end of any of the side panels interlocks with the second side end of any other side panel. As seen in the drawing figures, the side ends 610/612 have corresponding notches 609 and extensions 611 that interlock similar to jigsaw puzzle pieces. The face of the notch is provided with a generally smooth surface whereas the faces of the extension include decorative patterns and/or texture on the two outward facing sides. As the notches 609 are covered by an extension of another side panel, the undecorated/textured notch surface is covered by an extension 611 which includes texture/decoration on the two outward facing sides (around the corner of the decorative post assembly). Preferably, when two side panels 600 are connected together, the notches 609 and extensions 611 of the connecting side ends 610/612 interlock to form a seam 615 having a plurality of transverse line segments, as depicted in FIG. 13. In preferred embodiments, the extensions 611 protrude out from the notches 609 approximately perpendicular thereto such that each transverse line segment of the seam 615 is approximately perpendicular to each adjacent transverse line segment. In some embodiments, the extensions 611 and notches 609 are shaped such that the transverse line segments of the seam 615 are at obtuse or acute angles to adjacent line segments. In other embodiments, the extensions 611 and notches 609 are shaped such that the transverse line segments are curved to form a seam having, for example, alternating concave and convex line segments. In the embodiment shown in the drawing figures, the front surface of the side panels 600 has a decorative surface 613. Preferably, the decorative surface 613 continues onto the outermost side surface of the extensions 611 of side ends 610/612, as shown in FIG. 8. Thus, when the side panels 600 are connected, the decorative surfaces 613 and the transverse line segments of the seam 615 give the base 30 a more realistic stone or brick appearance, as shown in FIG. 13. In the embodiments shown, the transverse line segments correspond with part of the stone line pattern on the decorative surfaces. There are additional simulated stone lines which are not part of the separable panels, but portions of the stone line pattern correspond with the extensions/notches described herein. The stone line pattern generally gives the appearance of mortar which would hold stones together.

Figure 9:
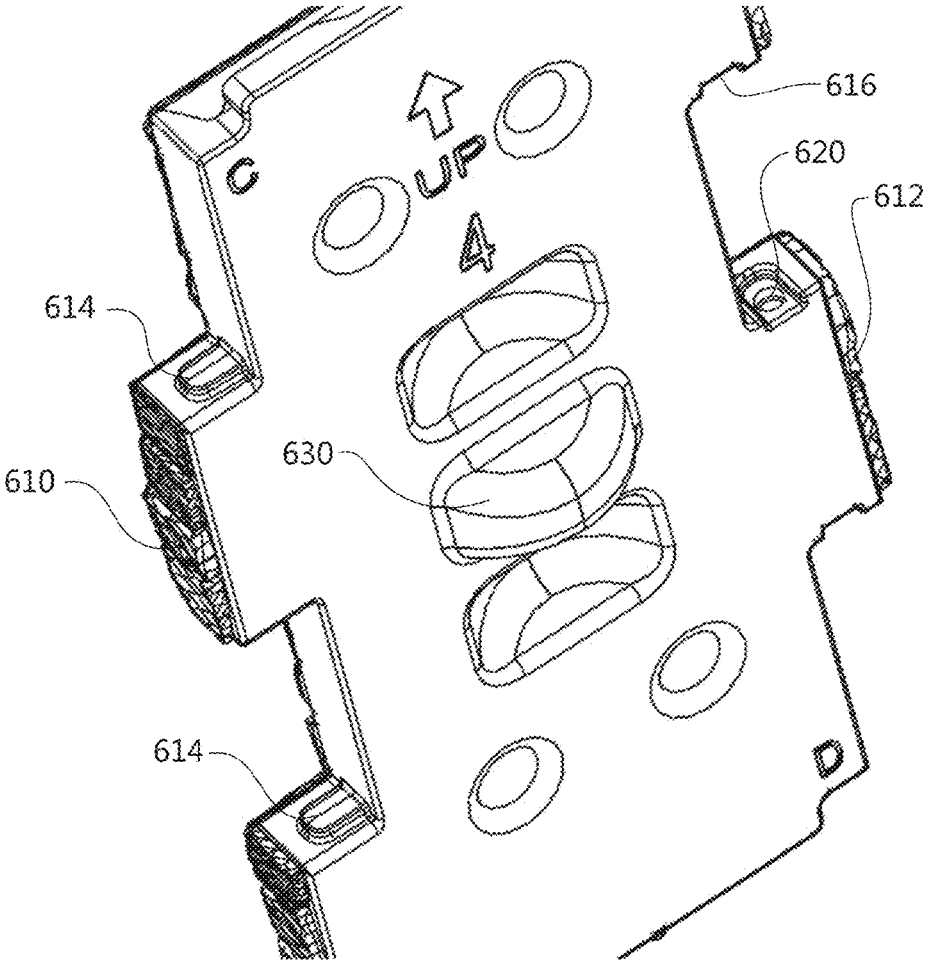
FIG. 9 is a rear perspective detail view of the first end of the side panel of FIG. 7.
Figure 10:
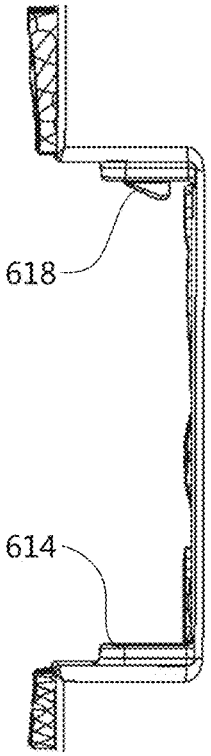
FIG. 10 is a rear elevational detail view of a portion of the first end of the side panel of FIG. 7.
Figure 11:
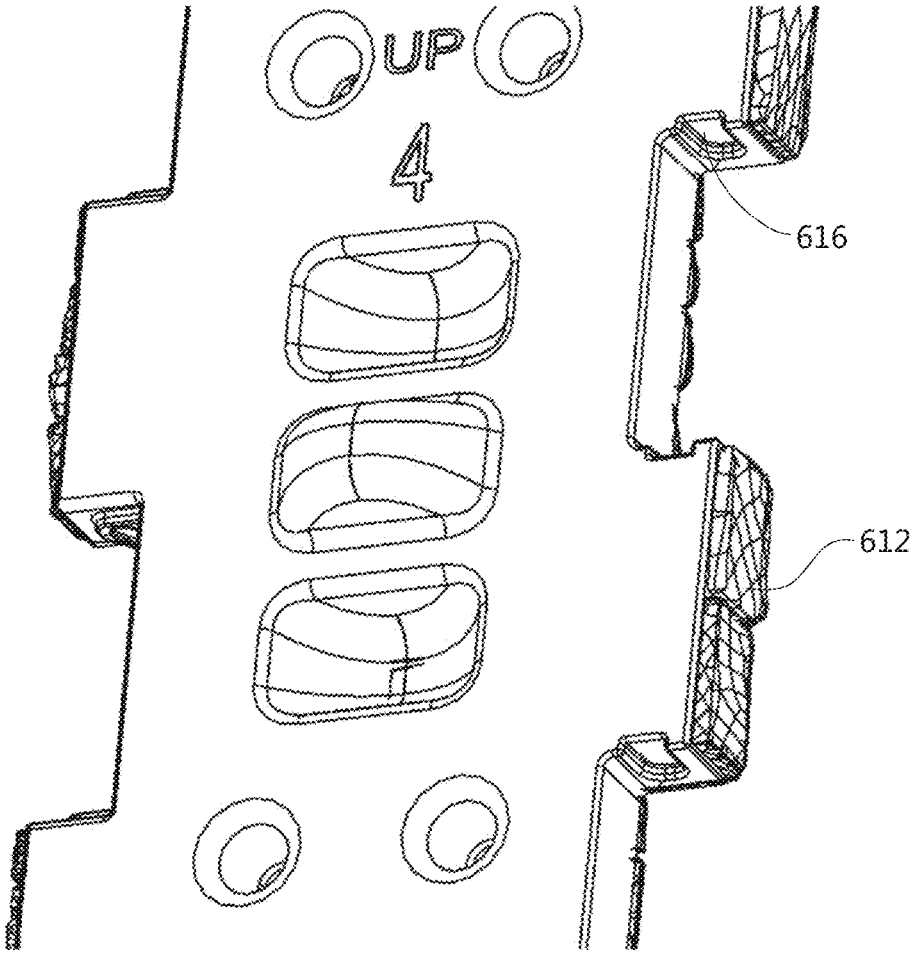
FIG. 11 is a rear perspective detail view of the second end of the side panel of FIG. 7.
Figure 12:
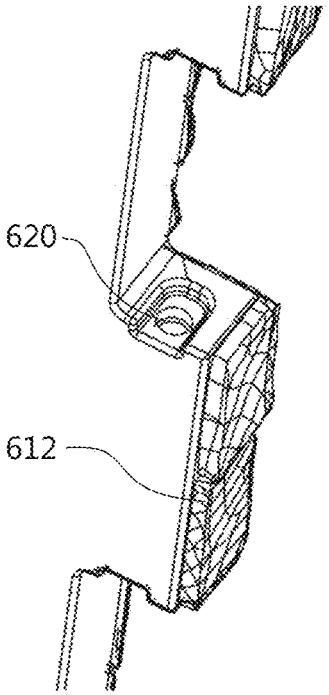
FIG. 12 is a rear perspective detail view of a portion of the second end of the side panel of FIG. 7.

In some embodiments, the first side end 610 of the side panels 600 has a male slide 614 located on a surface defining the top of each extension 611 and the second side end 612 has a female slide 616 located on a surface defining the bottom of each extension 611, as shown in FIG. 9. The male slides 614 each have an elongated protrusion, and the female slides 616 each have an elongated trough that corresponds to the elongated protrusion of a male slide 614. The male and female slides interact to properly align the side panels as they interlock.

In preferred embodiments, the first side end 610 of the side panels 600 has a male snap-lock 618 located on a surface defining the bottom of each extension 611, and the second side end 612 has a female snap-lock 620 located on a surface defining the top of each extension 611. The male snap-locks 618 each have an elongated protrusion with a centrally located tab projecting down from the elongated protrusion. The female snap-locks 620 each have an elongated trough, which corresponds to the elongated protrusions of a male snap-lock 618, and a centrally located recess adapted to receive the tab of a male snap-lock 618. The elongated protrusions and troughs of the male and female snap-locks interact to properly align the tabs and recesses of the male and female snap-locks such that when the side panels are fully interlocked, the tab of each male snap-lock drops into the recess of each corresponding female snap-lock to secure the side panels together.

In some embodiments, each side panel is uniquely shaped for when it is desired to form a base having an irregular shape. In these embodiments, the side panels preferably still interlock as described above, and the side panels are sequentially marked, labeled, engraved, etc., to simplify the post cover assembly.

In some embodiments, each side panel 600 has at least one protrusion 630 on the rear surface 608. The protrusions 630 are sized and configured such that they bear against the sleeve 20 when the base 30 is installed on the sleeve 20, as shown in FIG. 2. The protrusions 630 increase the stability of the post cover 10 by filling the gap between the body 60 of the base 30 and the sleeve 20 in embodiments where the interior perimeter of the body 60 is larger than the outer perimeter of the bottom end 22 of the sleeve 20. Preferably, the location of the protrusions 630 alternates between several locations on each side panel 600 such that the side panels 600 can nest together to reduce the package density when the post cover 10 is sold/shipped as a kit.

Figure 17:
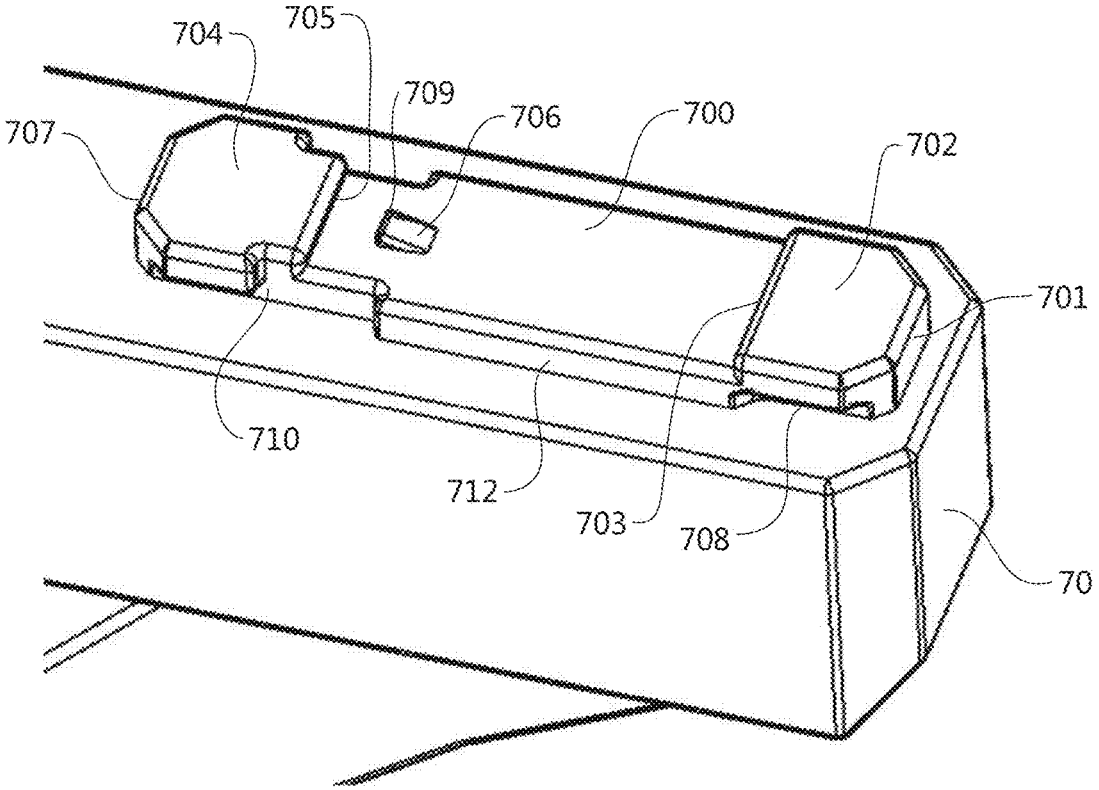
FIG. 17 is a top perspective detail view of the arm of the post cover of FIG. 1.

In some embodiments, the post cover 10 includes an arm 70 adapted to support a mailbox via a mailbox mounting plate 80. As shown in FIG. 17, the arm 70 has a protrusion 700 located on a top surface of the arm near the distal end of the arm. Protrusion 700 has a distal raised end 702, a proximal raised end 704, and a ramped tab 706 located between the two raised ends closer to the proximal raised end. The distal raised end 702 has a distal edge 701 and a proximal edge 703. The proximal raised end 704 has a distal edge 705 and a proximal edge 707. The ramped tab 706 has a raised edge 709 facing distal edge 705. The protrusion 700 has lateral walls 712 running parallel with a longitudinal axis of the protrusion 700, distal lateral channels 708 formed as undercuts in the distal raised end 702, and proximal lateral channels 710 formed as undercuts in the proximal raised end 704 and cut-outs in the lateral walls 712.

Figure 18:
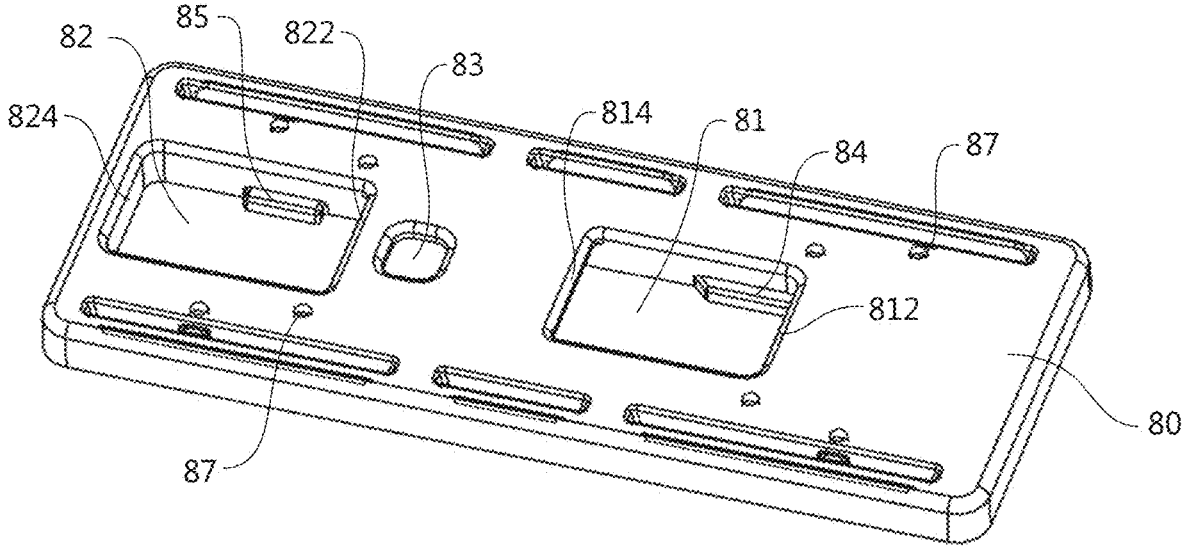
FIG. 18 is a top perspective view of the mailbox mounting plate of the post cover of FIG. 1.
Figure 19:
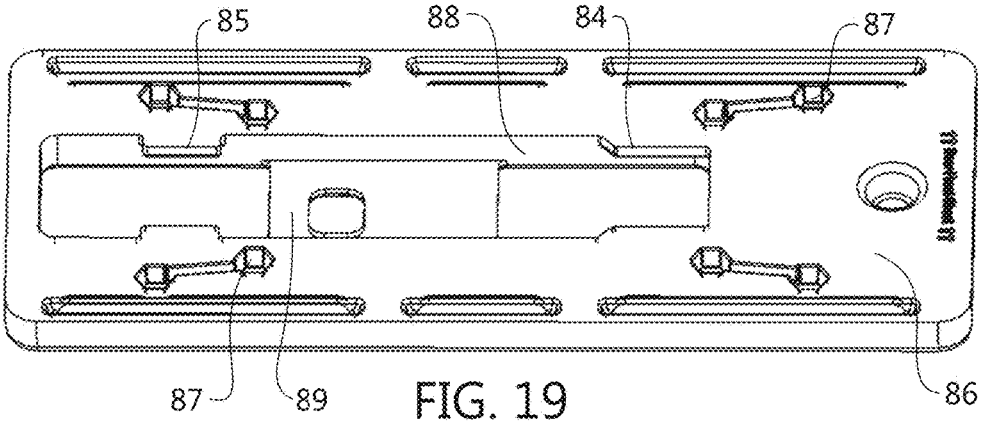
FIG. 19 is a bottom perspective view of the mailbox mounting plate of FIG. 18.

Preferably, the mailbox mounting plate 80 is shaped to correspond to protrusion 700 such that the plate 80 can be secured to the protrusion 700 in a slide-lock manner. As shown in FIG. 18, the plate 80 has a distal opening 81, a proximal opening 82, and a medial opening 83 located between the distal and proximal openings closer to the proximal opening. The distal opening 81 has a distal edge 812, a proximal edge 814, and lateral projections 84. The proximal opening 82 has a distal edge 822, a proximal edge 824, and lateral projections 85. Lateral projections 84/85 are located on lateral interior walls 88 and are preferably flush with the bottom surface 86 of the plate 80, as depicted in FIG. 19. The plate 80 also includes holes 87 through which screws, or other fastening elements, can pass to attach a mailbox to the plate 80.

Figure 20:
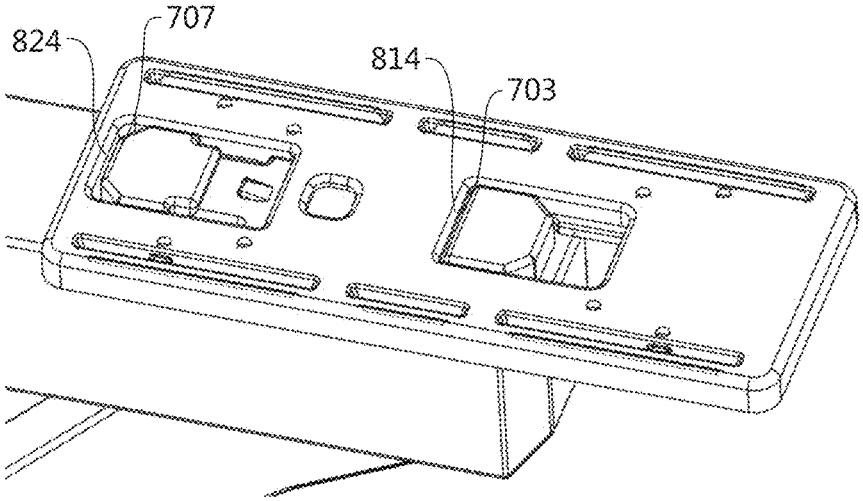
FIG. 20 is a top perspective detail view of the mailbox mounting plate attached to the arm in an unlocked position.
Figure 21:
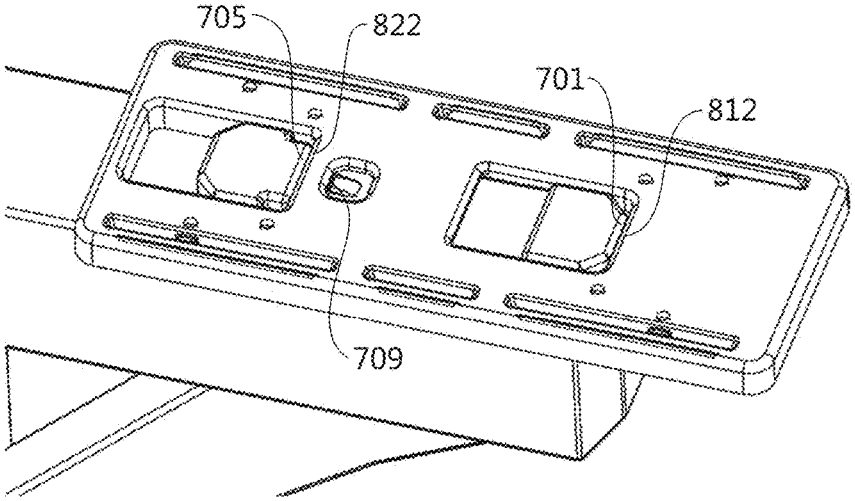
FIG. 21 is a top perspective detail view of the mailbox mounting plate attached to the arm in a locked position.

FIGS. 20-21 show the preferred process for attaching the mailbox mounting plate 80 to the arm 70. First, the plate 80 is inserted vertically onto the protrusion 700 such that the proximal edge 703 of the distal raised end 702 is in contact with the proximal edge 814 of the distal opening 81, and the proximal edge 707 of the proximal raised end 704 is in contact with the proximal edge 824 of the proximal opening 82, as shown in FIG. 20. In this unlocked position, the lateral protrusions 84/85 are aligned with the lateral channels 708/710, and the ramped tab 706 is aligned with the medial opening 83. Next, the plate 80 is slid horizontally along the arm 70 toward the sleeve 20 such that the lateral protrusions 84/85 enter the lateral channels 708/710 and the median bottom surface 89 defining the opening 83 slides up the ramped tab 706 until the raised edge 709 snaps into place within the opening 83, as depicted in FIG. 21. In this locked position, the distal edge 701 of the distal raised end 702 is in contact with the distal edge 812 of the distal opening 81, the distal edge 705 of the proximal raised end 704 is in contact with the distal edge of the proximal opening 82, and the raised edge 709 of the ramped tab 706 secures the plate 80 to the arm 70 by resisting sliding of the plate 80 away from the sleeve 20 such that the lateral protrusions 84/85 cannot disengage from the lateral channels 708/710.

In preferred embodiments, the arm 70 is part of the sleeve 20, which are blow-molded to form one piece. In some embodiments, the arm 70 is separate from the sleeve 20 and requires installation by inserting a first end of the arm 72 through a through-hole in the sleeve 20 positioned near the upper end of the sleeve 21 and secured to the sleeve via fasteners, such as bolts, screws, and the like. In some embodiments, the arm 70 includes a support member 76. Preferably, the support member 76 is blow-molded with the arm 70 and sleeve 20 to form one piece, but the support member 76 may also be part of a separate arm 70 to be attached to the sleeve 20 by inserting the lower end of the support member 77 into a hole in the sleeve 20 below the through-hole and secured via fasteners. As shown in FIG. 1, the installed arm 70 is approximately perpendicular to the longitudinal axis of the sleeve 20.

Preferably, the post cover 10 is assembled according to the following method. First, the bottom end 22 of the sleeve 20 is inserted through the through-hole 42 of the top cap 40. Second, the top cap 40 is secured to the sleeve 20 by sliding the top cap 40 along the length of the sleeve 20 until the top cap 40 passes over the uppermost of the plurality of tapered exterior projections 25. Third, the body 60 of the base 30 is assembled by interlocking all of the side panels 600 together as described above. Fourth, the assembled base 30 is placed around the bottom end 22 of the sleeve 20 and secured to the top cap 40 by inserting the top flanges 606 of the body 60 into the channel 46 of the top cap 40. Fifth, the bottom end 22 of the sleeve 20 is placed in the through-hole 52 of the bottom cap 50. Sixth, the bottom cap 50 is attached to the sleeve 20 by sliding the bottom cap 50 along the length of the sleeve 20 until the bottom cap 50 passes over the lowermost of the plurality of tapered exterior projections 25. Preferably, as the bottom cap 50 attaches to the sleeve 20 the bottom flanges 606 of the body 60 insert into the channel 56 of the bottom cap 50 to fully assemble the base 30 of the post cover 10. Finally, the assembled post cover 10 is preferably installed on a post that has been buried and secured in a desired location by inserting the post through the open bottom end 22 and into the hollow interior 23 of the sleeve 20. In some embodiments, the sleeve 20 includes a pre-attached arm 70, and assembly of the post cover 10 includes the additional step of securing a mailbox to the arm 70 via mailbox mounting plate 80. In other embodiments, assembly of the post cover 10 includes the additional steps of installing an arm 70 to the sleeve 20, and securing a mailbox to the arm 70 via mailbox mounting plate 80.

Although the invention has been described with reference to a particular arrangement of parts, features, and the like, and a particular method of assembling these arrangements and features, these are not intended to exhaust all possible arrangements, features, or methods of assembly. Indeed, many other modifications and variations will be ascertainable to those of skill in the art.

What is claimed is:

1. A blow molded post cover comprising:

a sleeve having an open bottom end and a hollow interior for receiving a post; and a base comprising:

a top cap having a first through-hole for receiving the sleeve;

a bottom cap having a second through-hole for receiving the sleeve; and a plurality of side panels securable to the top cap and the bottom cap, each of the plurality of side panels having one or more protrusions on a rear surface such that each of the one or more protrusions bears against the sleeve when the base is installed on the sleeve.

2. The post cover of claim 1, wherein each of the plurality of side panels further comprises:

a top end securable to the top cap of the base;

a bottom end securable to the bottom cap of the base;

a first side end; and a second side end;

wherein the first side end of any one of the plurality of side panels is configured to interlock with the second side end of any other one of the plurality of side panels.

3. The post cover of claim 2, wherein the first side end and the second side end of each of the plurality of side panels comprise a series of notches and extensions such that the notches and extensions of the first side end of a first side panel interlock with the extensions and notches of the second side end of a second side panel to secure the first side panel to the second side panel and form a seam having a plurality of transverse line segments;

wherein each of the plurality of side panels further comprises a decorative surface, the decorative surface located on a front face of the side panel and continuing onto surfaces of each extension of the first and second side ends.

4. The post cover of claim 3, wherein the plurality of transverse line segments of the seam are straight line segments, each straight line segment being generally perpendicular to its adjacent straight line segments.

5. The post cover of claim 2, wherein each of the plurality of side panels further comprises:

at least one male slide and at least one male snap-lock located on the first side end; and at least one female slide and at least one female snap-lock located on the second side end;

wherein when a first side panel is interlocked with a second side panel, the at least one male slide of the first side panel engages the at least one female slide of the second side panel to align the first and second side panels, and the at least one male snap-lock of the first side panel engages the at least one female snap-lock of the second side panel to lock the first and second side panels together.

6. The post cover of claim 1, wherein the sleeve further comprises a plurality of interior flexible protuberances configured to bear against the post.

7. The post cover of claim 1, wherein the base further comprises:

a first channel adjacent peripheral edges of a bottom surface of the top cap, the first channel configured to receive a top flange of the top end of each of the plurality of side panels to secure the side panels to the top cap; and a second channel adjacent peripheral edges of a top surface of the bottom cap, the second channel configured to receive a bottom flange of the bottom end of each of the plurality of side panels to secure the side panels to the bottom cap.

8. The post cover of claim 1, wherein the sleeve further comprises a plurality of tapered exterior projections configured to interact with the top and bottom caps to secure the base to the sleeve.

9. The post cover of claim 1, wherein the sleeve further comprises at least one arm adapted to support at least one mailbox.

10. A method of assembling a blow molded post cover, the method comprising the steps of:

inserting a sleeve through a first through-hole of a top cap of a base to secure the top cap of the base to the sleeve;

securing a body of the base to the top cap;

placing the sleeve in a second through-hole of a bottom cap of the base; and attaching the bottom cap of the base to the sleeve and to the body;

wherein the sleeve has an open bottom end and a hollow interior for receiving a post therein.

11. The method of claim 10, wherein before the securing step, the method further comprising the step of:

interlocking a plurality of side panels together to form the body of the base;

wherein each of the plurality of side panels comprises:

a first side end having at least one male slide and at least one male snap-lock; and a second side end having at least one female slide and at least one female snap-lock;

wherein when a first side panel is interlocked with a second side panel, the at least one male slide of the first side panel engages the at least one female slide of the second side panel to align the first and second side panels, and the at least one male snap-lock of the first side panel engages the at least one female snap-lock of the second side panel to lock the first and second side panels together.

12. The method of claim 10, further comprising the step of:

inserting the post through the open bottom end into the hollow interior of the sleeve.

13. The method of claim 10, further comprising the step of:

installing at least one arm to the sleeve, the at least one arm adapted to support at least one mailbox.

14. A kit for assembling a blow molded post cover comprising:

a sleeve having an open bottom end and a hollow interior for receiving a post; and a base comprising:

a top cap having a first through-hole for receiving the sleeve;

a bottom cap having a second through-hole for receiving the sleeve; and a plurality of side panels securable to the top and bottom caps, each of the plurality of side panels having a first side end, a second side end, and one or more protrusions on a rear surface such that each of the one or more protrusions bears against the sleeve when the base is installed on the sleeve;

wherein the first side end of any one of the plurality of side panels is configured to interlock with the second side end of any other one of the plurality of side panels.

15. The kit of claim 14, wherein the first side end and the second side end of each of the plurality of side panels comprise a series of notches and extensions such that the notches and extensions of the first side end of a first side panel interlock with the extensions and notches of the second side end of a second side panel to secure the first side panel to the second side panel and form a seam having a plurality of transverse line segments, the plurality of transverse line segments of the seam are straight line segments, each straight line segment being generally perpendicular to its adjacent straight line segments;

wherein each of the plurality of side panels further comprises a decorative surface, the decorative surface located on a front face of the side panel and continuing onto surfaces of each extension of the first and second side ends.

16. The kit of claim 14, wherein each of the plurality of side panels further comprises:

at least one male slide and at least one male snap-lock located on the first side end; and at least one female slide and at least one female snap-lock located on the second side end;

wherein when a first side panel is interlocked with a second side panel, the at least one male slide of the first side panel engages the at least one female slide of the second side panel to align the first and second side panels, and the at least one male snap-lock of the first side panel engages the at least one female snap-lock of the second side panel to lock the first and second side panels together.

17. The kit of claim 14, wherein the sleeve further comprises a plurality of interior flexible protuberances configured to bear against the post.

18. The kit of claim 14, wherein the base further comprises:

a first channel adjacent peripheral edges of a bottom surface of the top cap, the first channel configured to receive a top flange of a top end of each of the plurality of side panels to secure the side panels to the top cap; and a second channel adjacent peripheral edges of a top surface of the bottom cap, the second channel configured to receive a bottom flange of a bottom end of each of the plurality of side panels to secure the side panels to the bottom cap.

19. The kit of claim 14, wherein the sleeve further comprises a plurality of tapered exterior projections configured to interact with the top and bottom caps to secure the base to the sleeve.

20. The kit of claim 14, further comprising at least one arm securable to the sleeve, the at least one arm adapted to support at least one mailbox.

* * * * *